US005867201A

United States Patent [19]

Ueda

[11] Patent Number: 5,867,201

[45] **Date of Patent: *Feb. 2, 1999**

[54] FIXER DEVICE FOR THERMAL PRINTER

[75] Inventor: Satoshi Ueda, Saitama, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 704,986

[22] Filed: Aug. 29, 1996

[30] Foreign Application Priority Data

Aug. 29, 1995 [JP] Japan ..... 7-220333

[51] Int. Cl.[6] ..... B41J 2/32

[52] U.S. Cl. ..... 347/212; 347/175

[58] Field of Search ..... 250/317.1, 319, 250/336.1; 347/171, 175, 238, 211, 244, 246, 177, 179, 135, 232, 236, 239, 253, 256; 355/66, 67, 68, 83, 88; 346/33 R, 33 A, 33 B

[56] References Cited

U.S. PATENT DOCUMENTS 5,486,856 1/1996 Katsuma et al. ..... 347/175

*Primary Examiner*—N. Le
*Assistant Examiner*—Anh T. N. Vo

[57] ABSTRACT

A fixer device for a color thermal printer has at least a yellow fixing ultraviolet lamp and an inverter. The inverter controls ray emitting intensity of the yellow fixing lamp in accordance with a lamp control value after a thermal recording image is effected to a thermosensitive recording sheet. The yellow fixing lamp applies ultraviolet rays to the recording sheet for fixation. The fixer device includes an irradiance sensor which measures irradiance of the yellow fixing lamp. Difference data is calculated as a difference between target irradiance data and data of the measured irradiance from the irradiance sensor. An irradiance difference multiplier multiplies the irradiance difference data by a gain value, to determine a correcting value. An integrator adds the correcting value to the lamp control value to correct the lamp control value, the inverter controlling the ray emitting intensity of the yellow fixing lamp in accordance with the corrected lamp control value. The gain value is also adjusted in accordance with a number of times the yellow fixing lamp is used.

29 Claims, 4 Drawing Sheets

| PRINTED SHEETS | COEFFICIENT C |
|---|---|
| 0 | 1.00 |
| 200 | 1.01 |
| 400 | 1.02 |
| 600 | 1.04 |
| | |

FIXER DEVICE FOR THERMAL PRINTER

BACKGROUND OF THE INVENTION

1. Field of the Invention

The present invention relates to a fixer device for a thermal printer. More particularly, the present invention relates to a fixer device for a thermal printer, in which ray emitting intensity of a fixing ultraviolet lamp can be regulated for stable fixation of an optically fixable coloring layer, even after long use of the fixing lamp.

2. Description Related to the Prior Art

A thermal printer has a thermal head, and is used with thermosensitive recording paper. The thermosensitive recording paper includes a support and at least one thermosensitive coloring layer, which is pressed and heated by the thermal head for recording an image. Then ultraviolet rays are applied to the recording paper to fix the image. There also exists color thermosensitive recording paper, which includes a support and cyan, magenta and yellow thermosensitive coloring layers.

The yellow coloring layer is overlaid the closest to the obverse, and has the highest thermal sensitivity. The yellow coloring layer is colored using little heat energy. The cyan coloring layer is overlaid the farthest from the obverse, and has the lowest thermal sensitivity. The cyan coloring layer is colored in cyan at a great heat energy. To print an image, a thermal head is pressed against the recording paper while the recording paper is moved. The thermal head applies heat to the recording paper, to effect the thermal recording to the respective coloring layers in the order from the yellow coloring layer toward the support. The yellow coloring layer and the magenta coloring layer are fixed when receiving application of ultraviolet rays having wavelength ranges specific to the yellow coloring layer and the magenta coloring layer respectively. During fixation, coloring components in the yellow coloring layer and the magenta coloring layer that are not colored are photochemically decomposed, to lose their coloring ability.

A yellow fixing ultraviolet lamp is driven to apply the near ultraviolet rays having an emitting peak of 420 nm to the yellow coloring layer. If the amount of ultraviolet rays applied to the yellow coloring layer is too small, a coloring component in the yellow coloring layer partially remains without optically decomposition. The yellow coloring component is colored during the recording of the magenta coloring layer. The ultraviolet rays for yellow fixation should not be applied at an amount over a suitable amount for fixing the yellow coloring layer, because there would be considerable influence of the ultraviolet rays for yellow fixation on the magenta coloring layer. Therefore the yellow fixing lamp is driven by properly adjusted energy.

The ultraviolet rays having an emitting peak of 365 nm is applied to the magenta coloring layer. If the amount of ultraviolet rays applied to the magenta coloring layer is too small, a coloring component in the magenta coloring layer partially remains without optically decomposing. The cyan coloring layer does not have photochemical fixability. It is allowable that the ultraviolet rays for magenta fixation is applied at an amount over a suitable amount for fixing the magenta coloring layer, because there is no influence of the ultraviolet rays for magenta fixation on the cyan coloring layer. Therefore a magenta fixing ultraviolet lamp is fully driven, because no adjustment of the ultraviolet rays for magenta fixation is required.

U.S. Pat. No. 5,486,856 discloses a feedback control, which is effected for the yellow fixing lamp by use of an irradiance sensor. The ray emitting intensity of the yellow fixing lamp is controlled to adjust a measured irradiance to be a target irradiance. The feedback control calculates a difference between the measured irradiance from the irradiance sensor and the target irradiance at which a suitable ray applying amount can be acquired in consideration of a conveying speed of the recording paper. The irradiance difference is multiplied by a constant gain value, to determine a correcting value. The lamp control value is corrected according to the correcting value, to set the measured irradiance equal to the target irradiance.

The fixing lamp has ray emitting intensity which decreases with time in the course of long use. In the known fixer device, the gain value is determined in a factory where the printer is manufactured and adjusted. If the ultraviolet lamp after the long time has a small ray emitting intensity, ray adjustment of the fixing lamp is slow. In printing operation, a considerable duration is required for acquiring the target irradiance. There occurs a problem in that a front portion of a recording area on a recording sheet is short of an amount of fixation.

SUMMARY OF THE INVENTION

In view of the foregoing problems, an object of the present invention is to provide a fixer device for a thermal printer, in which ray adjustment of a fixing ultraviolet lamp can be effected rapidly and stably during degradation of the fixing lamp over time.

In order to achieve the above and other objects and advantages of this invention, an irradiance sensor measures irradiance of the first fixing lamp. A first arithmetic unit determines difference data between target irradiance data and data of the measured irradiance from the irradiance sensor. An irradiance difference multiplier multiplies the irradiance difference data by a gain value, to determine a correcting value. A second arithmetic unit adds the correcting value to the lamp control value to correct the lamp control value, the lamp controller controlling the ray emitting intensity of the first fixing lamp in accordance with the corrected lamp control value. A gain adjustor adjusts the gain value in accordance with an amount of use of the first fixing lamp.

In a preferred embodiment, the thermal printer includes a counter for counting times of effecting the thermal recording and driving the first fixing lamp. The gain adjustor sets the gain value greater according to number of the recording times in response to a signal from the counter.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figures 1, 1A:
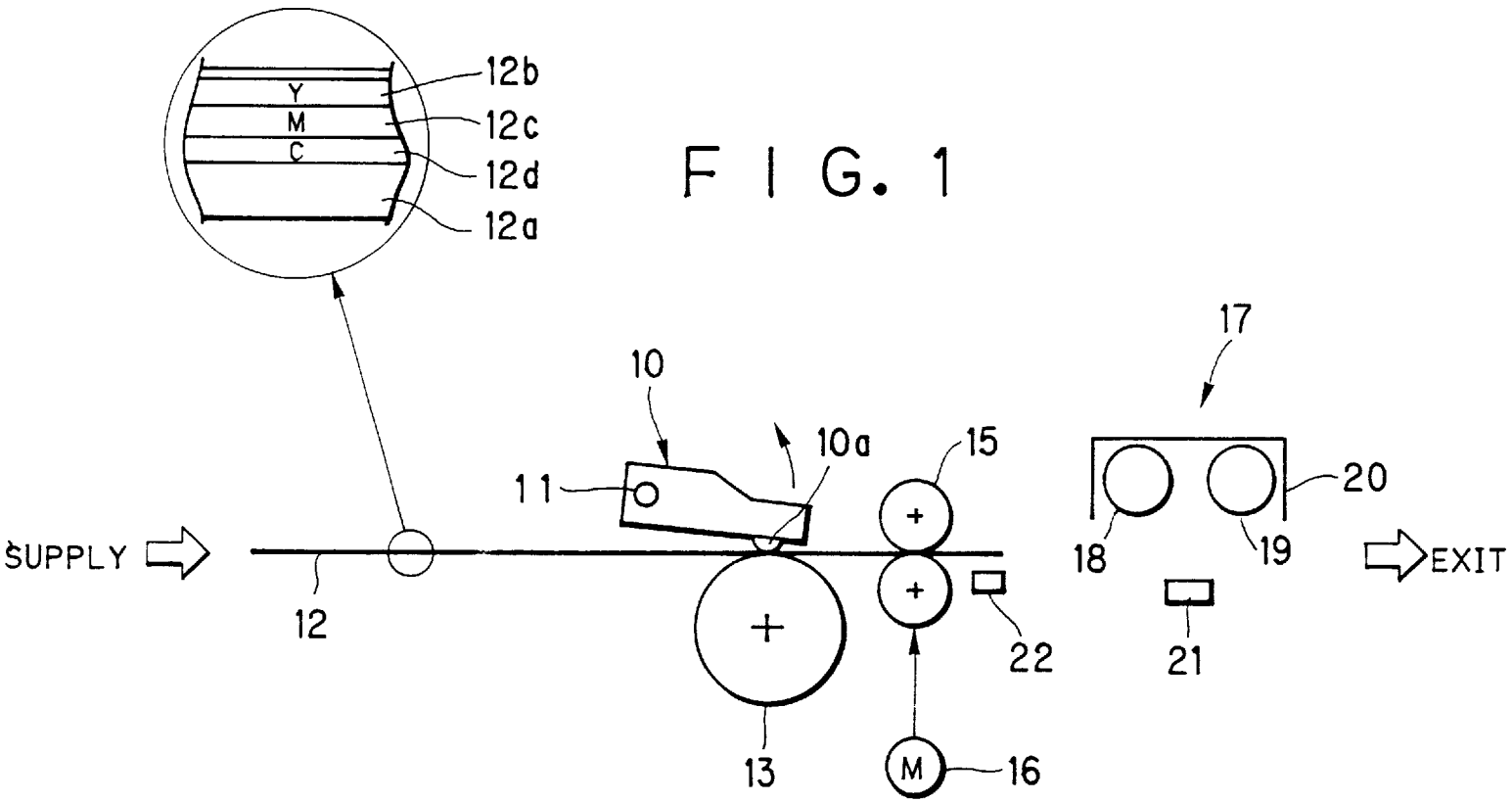
FIGS. 1 and 1*a* are explanatory views which illustrate is an explanatory view illustrating a color thermal printer.

In FIG. 1, a thermal head 10 includes an array 10*a* of heating elements arranged in line. The thermal head 10 is swingable about a shaft 11, and between a printing position and a retreating position. In the printing position, the thermal head 10 presses a color thermosensitive recording sheet 12 on a platen roller 13.

The recording sheet 12 includes a support and cyan, magenta and yellow thermosensitive coloring layers. The yellow coloring layer is overlaid the closest to the obverse, and has the highest thermal sensitivity. The yellow coloring layer is colored using little heat energy. The cyan coloring layer is overlaid the farthest from the obverse, and has the lowest thermal sensitivity. The cyan coloring layer is colored using a great heat energy. When near ultraviolet rays having a wavelength of about 420 nm is applied to the yellow coloring layer, its coloring ability is destroyed. When ultraviolet rays having a wavelength of about 365 nm is applied to the magenta coloring layer, its coloring ability is destroyed.

There are disposed a pair of transport rollers 15 downstream from the thermal head 10. The transport rollers 15 are rotated in forward and reverse directions by a stepping motor 16. The transport rollers 15 pinch the recording sheet 12 and cause the recording sheet 12 to move reciprocally.

A fixer device 17 includes a yellow fixing ultraviolet lamp 18 and a magenta fixing ultraviolet lamp 19. The yellow fixing lamp 18 emanates the near ultraviolet rays peaking at 420 nm. The magenta fixing lamp 19 emanates the ultraviolet rays peaking at 365 nm. A reflector 20 is disposed behind fixing lamps 18 and 19.

An irradiance sensor 21 receives ultraviolet rays emitted from the yellow fixing lamp 18, and measures irradiance of a surface of the recording sheet 12 indirectly. Reference numeral 22 designates a position sensor for detecting a front edge of the recording sheet 12.

Figure 2:
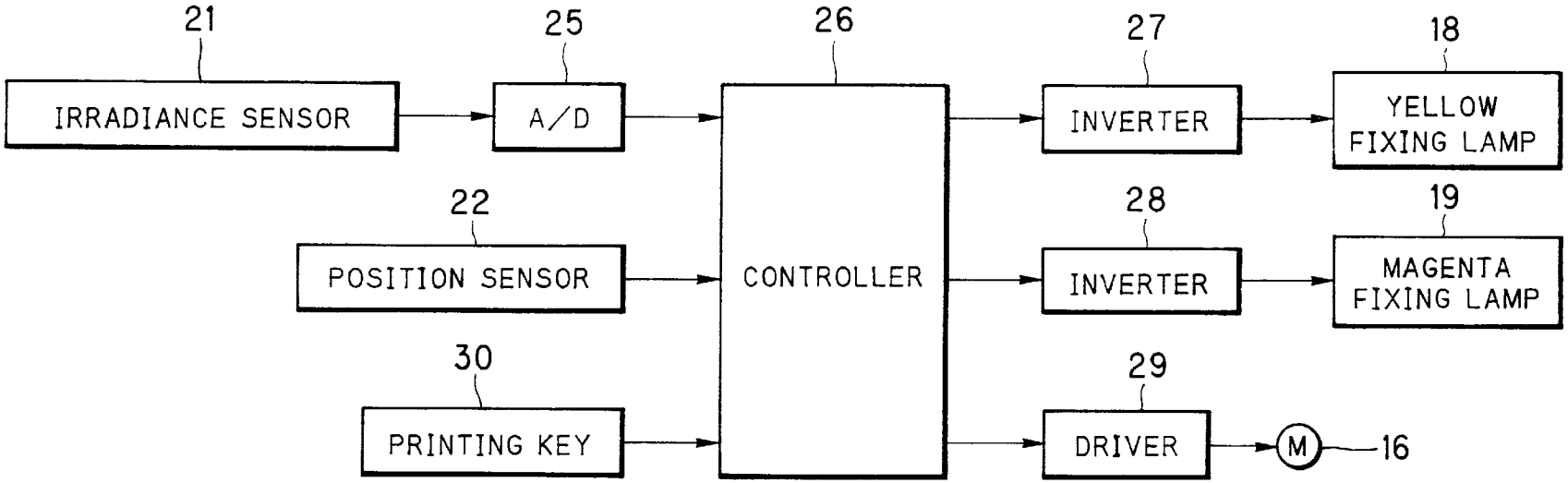
FIG. 2 is a block diagram illustrating circuitry of a fixer device.

In FIG. 2, the measuring signal from the irradiance sensor 21 is digitally converted by an A/D converter 25 into a measured irradiance value, which is sent to a controller 26. The controller 26 changes a gain value in accordance with changes of the yellow fixing lamp 18 with time, and effects a feedback control of the yellow fixing lamp 18 according to the gain value. Only the yellow fixing lamp 18 is regulated for ray emission by the feedback control, while the magenta fixing lamp 19 is constantly operated at its full intensity. It is to be noted that the present invention is applicable to a fixer device in which both the fixing lamps 18 and 19 are regulated by the feedback control.

The fixing lamp has a predetermined number of steps at which the light intensity is changeable, for example, 265 steps. The controller 26 sends inverters 27 and 28 a signal of a lamp control value from zero to 255. If the lamp control value is 155, a duty factor of the drive pulse for driving the fixing lamp is 50%. If the lamp control value is 255, the duty factor of the drive pulse for the fixing lamp is 100%. The measured irradiance output from the A/D converter 25 is converted to a value from zero to 255 in accordance with the measuring signal.

The controller 26 receives a signal from the position sensor 22 to detect a position of the recording sheet 12, and controls a rotational speed and direction of the stepping motor 16 via a driver 29. Reference numeral 30 designates a printing key for commanding a start of a printing operation.

Figure 3:
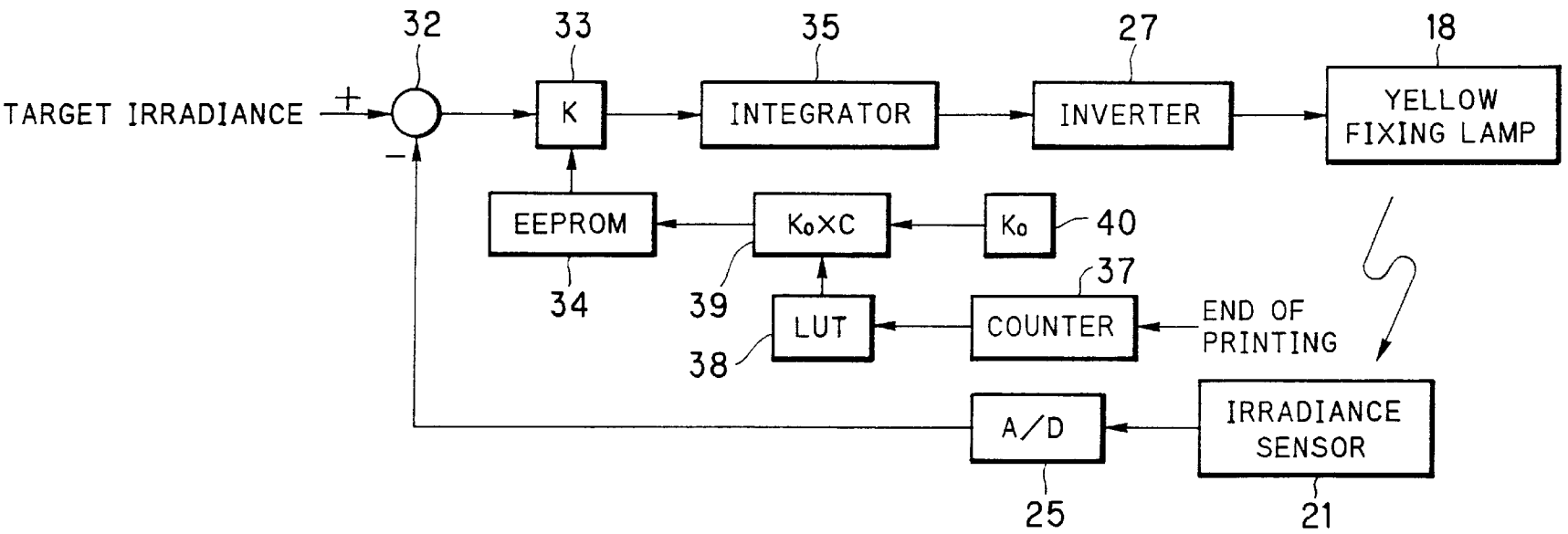
FIG. 3 is a block diagram illustrating relevant circuits for feedback control of the fixer device.

FIG. 3 schematically illustrates a feedback control structure of the yellow fixing lamp. During the fixation of a yellow image, the ultraviolet rays from the yellow fixing lamp 18 for the yellow fixation is measured by the irradiance sensor 21. The measuring signal from the irradiance sensor 21 is digitally converted by the A/D converter 25. The measured irradiance value from the A/D converter 25 is sent to an adder/subtracter unit 32, namely a summing point.

The adder/subtracter unit 32 calculates a difference between a predetermined target irradiance value and a measured irradiance value, to output an irradiance difference. There is connected an irradiance difference multiplier 33, in which a gain value K read from an EEPROM (electrically erasable programmable read only memory) 34 is set. The EEPROM 34 is used as a gain memory. The irradiance difference is multiplied by the gain value K, to obtain a correcting value as a product. An integrator 35 integrates the correcting value. Namely the integrator 35 adds the correcting value to an initial lamp control value, to obtain a sum, which is sent to the inverter 27 as a new lamp control value. Note that the magenta fixing lamp 19 is fully driven without adjustment. The lamp control value of "255" as a target irradiance value is directly sent to the inverter 28.

A counter 37 counts the number of printed sheets one after another, to determine a total of the printed sheets. In accordance with a count of the counter 37, a coefficient C is read from a coefficient table memory 38 each time the count comes up to a predetermined number, for example 200. The coefficient table memory 38 includes a look-up table memory (LUT).

It general, the ray emitting intensity of a fixing ultraviolet lamp decreases with time, but lowered at a common ratio. For the purpose of determining the lowering ratio of the intensity, a great number of ultraviolet lamps are previously subjected to experiments, to observe their degradation statistically relative to a degree of use. If the degree of use is represented by total time of lamp actuating time, a timer is required for measuring the time. Alternatively the degree of use can be represented by a number of printed sheets. This is favorable due to its simplicity in determining the degree of the use, because the printer readily has a counter for counting the printed sheets.

Figures 4, 5:
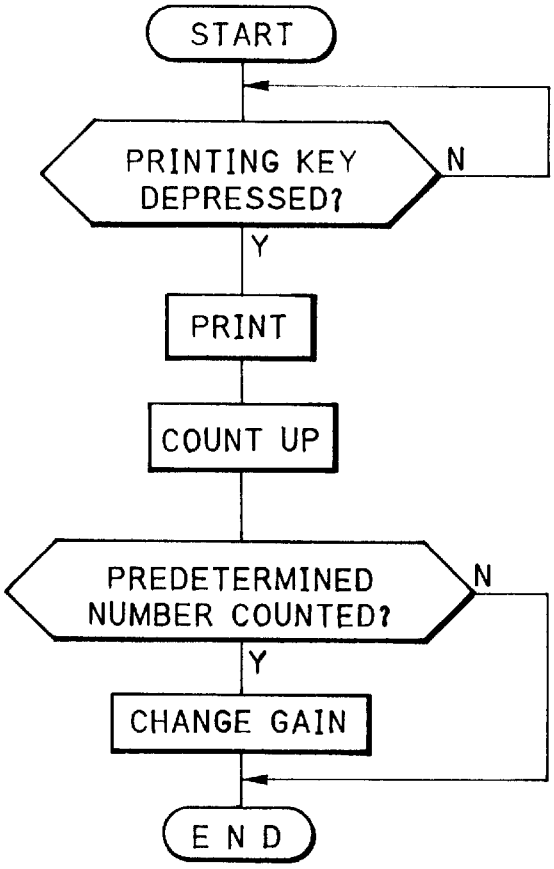
FIG. 4 is a table illustrating table data stored in a coefficient table memory.
FIG. 5 is a flow chart illustrating a process of changing a gain value.

In the present embodiment, the coefficient table memory 38 stores table data of which an address is the total number of the printed sheets, and which represents the coefficient C, as illustrated in FIG. 4. Each time the count comes up to the predetermined number, the coefficient C is read from the coefficient table memory 38, and transferred to a coefficient multiplier 39. The coefficient multiplier 39 multiplies the coefficient by an initial gain value K0 read from a ROM 40, to obtain a gain value K. The gain value K is written to the EEPROM 34.

The initial gain value K0 is predetermined in consideration of ray emitting characteristics of individual ultraviolet lamps and in a factory for manufacturing the printer. The initial gain value K0 is experimentally obtained optimally for each of various irradiance values. Irradiance of the fixing lamp when fully driven is measured, to determine the initial gain value K0. It is to be noted that, if the magenta fixing lamp 19 is desired to be regulated, a feedback control system similar to that of FIG. 3 can be used.

Operation of the above construction is now described by referring to FIG. 5. The printing key 30 is manually operated. In response to this, the controller 26 reads the gain value K from the EEPROM 34, and sets the gain value K to the irradiance difference multiplier 33.

The recording sheet 12 is advanced from a feeder cassette (not shown), and conveyed to the thermal head 10. During the conveyance, the thermal head 10 is set in the retreating position away from the platen roller 13. The recording sheet 12 is passed between the thermal head 10 and the platen roller 13, and nipped by the transport rollers 15.

After starting the transport rollers 15, the stepping motor 16 is rotated, to convey the recording sheet 12. The front edge of the recording sheet 12 is detected by the position sensor 22, to start a yellow printing process. The thermal head 10 is swung in a clockwise direction to the printing position for pressing the recording sheet 12. The heating element array 10*a* of the thermal head 10 is driven according to yellow coloring heating data, to record a yellow image one line after another in a recording area of the recording sheet 12.

When the yellow image is recorded, the controller 26 sends the target irradiance value being predetermined to the adder/subtracter unit 32. To start actuating the yellow fixing lamp 18, the target irradiance value is sent to the irradiance difference multiplier 33, to multiply the gain value K thereby. The correcting value as obtained is sent to the inverter 27 as lamp control value through the integrator 35. The inverter 27 determines a duty factor of the drive pulse according to the lamp control value. The yellow fixing lamp 18 is driven with the drive pulse.

While the yellow fixing lamp 18 emanates ultraviolet rays, the irradiance sensor 21 measures irradiance of the ultraviolet rays for the yellow fixation. The measuring signal is digitally converted by the A/D converter 25 into the measured irradiance value, which is fed back to the adder/subtracter unit 32. The adder/subtracter unit 32 effects subtraction, to obtain the difference between the target irradiance value and the measured irradiance value. The irradiance difference is sent to the irradiance difference multiplier 33.

The irradiance difference multiplier 33 multiplies the irradiance difference by the gain value K, to obtain the correcting value. The correcting value is added to the initial lamp control value by the integrator 35. As a result, the integrator 35 integrates the correcting value to obtain the lamp control value. The inverter 27 sets the duty factor of the drive pulse in accordance with the lamp control value. This feedback control being effected, ray intensity of the yellow fixing lamp 18 is changed to a level for obtaining the target irradiance value. After the ray intensity of the yellow fixing lamp 18 comes to a regulated state, the feedback control is still continued, to keep the ray intensity regulated.

A yellow recorded region of the recording sheet 12 comes to the bottom of the yellow fixing lamp 18 under the feedback control. Then the yellow fixing lamp 18 applies the near ultraviolet rays to the recording sheet 12 to fix the yellow recorded region.

A conveying amount of the recording sheet 12 is measured by counting drive pulses of the stepping motor 16. According to the counted number of the drive pulses, it is detected that a rear edge of the recording sheet 12 comes to a return starting position close to the transport rollers 15. The yellow printing process is terminated.

The controller 26 then switches off the yellow fixing lamp 18, and causes the thermal head 10 to rotate in the counter-clockwise direction, to move to the retreating position. Then the stepping motor 16 rotates in the reverse direction, to return the recording sheet 12 to the starting position of FIG. 1.

Upon returning the recording sheet 12 to the starting position, the stepping motor 16 rotates in the forward direction. The thermal head 10 is moved to the printing position to start recording a magenta image. In the magenta recording, the controller 26 sends the lamp control value of "255" to the inverter 28, to drive the magenta fixing lamp 19 fully.

In the magenta printing process, a magenta image is recorded one line after another in the recording area. A magenta recorded region of the recording sheet 12 comes to the bottom of the magenta fixing lamp 19. Then the magenta fixing lamp 19 applies the ultraviolet rays to the recording sheet 12 to fix the magenta recorded region. The magenta fixing lamp 19 is actuated until the recording sheet 12 is exited.

At the end of printing magenta, the stepping motor 16 is rotated in the reverse direction, to return the recording sheet 12 to the starting position. A cyan printing process is started next. The stepping motor 16 is rotated again in the forward direction, to convey the recording sheet 12 at the constant speed. During the conveyance, the thermal head 10 records a cyan image one line after another in the recording area.

The recording sheet 12, after the three-color frame-sequential full-color recording, is exited to a receptacle tray (not shown), while the ultraviolet rays for the magenta fixation are still emanated.

The counter 37 is stepped up each time of printing one sheet. The controller 26 monitors the total number of the printed sheets from the counted number of the counter 37. Each time of printing 200 sheets, or another predetermined number, the coefficient C is read from the coefficient table memory 38 according to the counted number of the counter 37, and is sent to the coefficient multiplier 39.

The coefficient multiplier 39 multiplies the coefficient C from the coefficient table memory 38 by the initial gain value K0 from the ROM 40, to obtain the new gain value K, which is written to the EEPROM 34. The gain value K stored in the EEPROM 34 is used in next printing operation. It follows that the feedback control is rendered quick and stable, as the gain value K is optimized in consideration of slow degradation of the yellow fixing lamp with time, each time after recording the predetermined number of sheets.

It is possible to fix the yellow and magenta images in the reverse conveyance of the recording sheet 12 as well as in the forward conveyance of the recording sheet 12. This is effective in using the fixing lamps of which a size and ray intensity are small to reduce a cost of the lamps. It is also possible that a rotatable holder is used for supporting the fixing lamps 18 and 19 at an interval of a suitable rotational angle, and that the holder is rotated to direct either one of the fixing lamps 18 and 19 to the recording sheet 12. This is effective in setting the fixing lamps 18 and 19 in an equal position to apply rays to the recording sheet 12. The conveying amount of the recording sheet 12 during the printing can be small, so that the width of the printer to be designed can be reduced.

Note that it is possible to use a platen drum having a great size, and to mount the color thermosensitive recording sheet on the platen drum, for recording each color per one rotation. Also the color thermosensitive recording sheet may include an additional, black thermosensitive coloring layer, and have four coloring layers in all. The present invention is applicable to monochromatic recording in use of a color thermosensitive recording sheet and/or monochromatic thermal printer. The present invention is applicable to a thermal printer having only one ultraviolet lamp.

In the above embodiment, the recording sheet 12 is rectangular and has a limited length. Alternatively continuous sheet may be used, and cut into a sheet.

Although the present invention has been fully described by way of the preferred embodiments thereof with reference to the accompanying drawings, various changes and modifications will be apparent to those having skill in this field.

Therefore, unless otherwise these changes and modifications depart from the scope of the present invention, they should be construed as included therein.

What is claimed is:

1. A fixer device for a thermal printer, having at least a first fixing ultraviolet lamp and a lamp controller, wherein the lamp controller controls a ray emitting intensity of said first fixing lamp in accordance with a lamp control value, and said first fixing lamp applies ultraviolet rays to recording paper for image fixation after thermal recording, said fixer device comprising:

an irradiance sensor for measuring irradiance of the first fixing lamp;

a first arithmetic unit for determining irradiance difference data between predetermined target irradiance data and data of the measured irradiance from said irradiance sensor;

an irradiance difference multiplier for multiplying the irradiance difference data by a gain value, to determine a correcting value;

a measuring device for measuring an amount of use of the first fixing lamp;

a second arithmetic unit for adding the correcting value to the lamp control value to produce a corrected lamp control value, the lamp controller controlling the ray emitting intensity of the first fixing lamp in accordance with the corrected lamp control value; and a gain adjustor for adjusting an initial gain value in accordance with the amount of use of the first fixing lamp to produce the gain value, which is transferred to said irradiance difference multiplier.

2. The fixer device of claim 1, wherein said gain adjustor increases the gain value as the amount of use of the first fixing lamp has been used increases.

3. The fixer device of claim 2, wherein the recording paper is a color thermosensitive recording paper, and includes a support and first to third thermosensitive coloring layers, the coloring layers being disposed on the support, the coloring layers being different in thermal sensitivity, thermally developing respective colors specific thereto, and being subjected to frame-sequential recording in an order from the first coloring layer toward the support;

said first fixing lamp emits the ultraviolet rays in a wavelength range specific to the first coloring layer, to fix the first coloring layer.

4. The fixer device of claim 3, wherein said measurement device is a counter for counting a number of times thermal recording has occurred;

said gain adjustor increases the gain value according to the number of times thermal recording has occurred in response to a signal from the counter.

5. The fixer device of claim 4, wherein the lamp controller includes includes an inverter for setting a duty factor of a signal for driving the first fixing lamp in accordance with the corrected lamp control value.

6. The fixer device of claim 5, wherein said gain adjustor includes:

a coefficient table memory for storing coefficients at an address for a number of recording time ranges; and a coefficient multiplier for multiplying the initial gain value by a coefficient read from said coefficient table memory, to adjust the gain value, the gain value being transferred to said irradiance difference multiplier.

7. The fixer device of claim 6, further comprising a second fixing ultraviolet lamp for emitting ultraviolet rays in a wavelength range specific to the second coloring layer, to fix said second coloring layer, the second coloring layer being disposed obversely but on an inside of the first coloring layer.

8. The fixer device of claim 7, wherein said second arithmetic unit is an integrator.

9. The fixer device of claim 7, wherein said second arithmetic unit is an integrator.

10. The fixer device of claim 8, said gain adjustor further comprising:

a ROM for storing the initial gain value to be transferred to said coefficient multiplier; and an erasable programmable ROM for storing the gain value being adjusted from said coefficient multiplier, the gain value being transferred from said erasable programmable ROM to said irradiance difference multiplier.

11. The fixer device of claim 10, wherein the first coloring layer develops yellow, the second coloring layer develops magenta, and the third coloring layers develops cyan.

12. The fixer device of claim 1, wherein the amount of use of the first fixing lamp is a number of times the first fixing lamp is driven.

13. The fixer device of claim 1, wherein the amount of use of the first fixing lamp is a number of times thermal recording is effected.

14. The fixer device of claim 1, wherein the amount of use of the first fixing lamp is a number of printed sheets produced by the thermal printer.

15. The fixer device of claim 1, wherein the amount of use of the first fixing lamp is a total activation time of the first fixing lamp.

16. A fixer device for applying ultraviolet rays to recording paper for image fixation after thermal recording of a thermal printer, comprising:

a first fixing ultraviolet lamp emitting ultraviolet light;

an irradiance sensor for measuring an irradiance of the ultraviolet light emitted by said first fixing ultraviolet lamp;

a measuring device for measuring an amount of use of the first fixing lamp; and a lamp controller for controlling an intensity of the ultraviolet light emitted by said first fixing ultraviolet lamp in accordance with the amount of use of said first fixing lamp.

17. The fixer device of claim 16, said lamp controller including, a first arithmetic unit for determining irradiance difference data between target irradiance data and the irradiance measured by said irradiance sensor;

a gain adjustor for adjusting the initial gain value in accordance with the number of times said first fixing lamp has been used to produce a gain value;

an irradiance difference multiplier for multiplying the irradiance difference data by the gain value, to obtain a correcting value;

a second arithmetic unit for adding the correcting value to an initial lamp control value to produce a corrected lamp control value, said lamp controller controlling the intensity of the ultraviolet light emitted by said first fixing ultraviolet lamp in accordance with the corrected lamp control value.

18. The fixer device of claim 17, wherein said gain adjustor increases the initial gain value as the number of times said first fixing lamp has been used increases.

19. The fixer device of claim 17, wherein said measurement device is a counter for counting the number of times said first fixing lamp has been used;

said gain adjustor increasing the initial gain value according to the number of times said first fixing lamp has been used in response to a signal from said counter.

20. The fixer device of claim 17, said gain adjustor including:

a coefficient table memory for storing coefficients at an address for a number of use ranges; and a coefficient multiplier for multiplying the initial gain value by a coefficient read from said coefficient table memory, to produce the gain value, the gain value, being transferred to said irradiance difference multiplier.

21. The fixer device of claim 17, said gain adjustor further comprising:

a ROM for storing the initial gain value to be transferred to said coefficient multiplier; and an erasable programmable ROM for storing the gain value adjusted by said coefficient multiplier, the gain value being transferred from said erasable programmable ROM to said irradiance difference multiplier.

22. The fixer device of claim 16, wherein recording paper used in the thermal printer is color thermosensitive recording paper, and includes a support and first to third thermosensitive coloring layers, the coloring layers being disposed on the support, the coloring layers being different in thermal sensitivity, thermally developing respective colors specific thereto, and being subjected to frame-sequential recording in an order from the first coloring layer toward the support;

said first fixing lamp emits the ultraviolet light in a wavelength range specific to the first coloring layer, to fix the first coloring layer.

23. The fixer device of claim 22, further comprising a second fixing ultraviolet lamp for emitting ultraviolet rays in a wavelength range specific to the second coloring layer, to fix said second coloring layer, the second coloring layer being disposed obversely but on an inside of the first coloring layer.

24. The fixer device of claim 22, wherein the first coloring layer develops yellow, the second coloring layer develops magenta, and the third coloring layers develops cyan.

25. The fixer device of claim 17, said lamp controller further including an inverter for setting a duty factor of a signal for driving said first fixing lamp in accordance with the corrected lamp control value.

26. The fixer device of claim 16, wherein the amount of use of the first fixing lamp is a number of times the first fixing lamp is driven.

27. The fixer device of claim 16, wherein the amount of use of the first fixing lamp is a number of times thermal recording is effected.

28. The fixer device of claim 16, wherein the amount of use of the first fixing lamp is a number of printed sheets produced by the thermal printer.

29. The fixer device of claim 16, wherein the amount of use of the first fixing lamp is a total activation time of the first fixing lamp.

* * * * *